United States Patent [19]

Hall et al.

[11] Patent Number: 4,577,357

[45] **Date of Patent: * Mar. 25, 1986**

[54] SELF-SEALING WATERBED MATTRESS

[75] Inventors: Charles P. Hall, Santa Rosa; Joseph Philipson, Pasadena, both of Calif.

[73] Assignee: Monterey Manufacturing Co., Carson, Calif.

[ * ] Notice: The portion of the term of this patent subsequent to Sep. 3, 2002 has been disclaimed.

[21] Appl. No.: 474,545

[22] Filed: Mar. 11, 1983

[51] Int. Cl.[4] ..... A47C 27/08

[52] U.S. Cl. ..... 5/451; 5/441; 5/449; 156/292; 428/912

[58] Field of Search ..... 5/449, 450, 451, 455, 5/441; 428/912

[56] References Cited

U.S. PATENT DOCUMENTS

| | | | |
|---|---|---|---|
| Re. 29,890 | 1/1979 | Gomberg . | |
| 3,421,163 | 1/1969 | Stoughton | 5/449 |
| 3,574,873 | 4/1971 | Weinstein | 5/451 X |
| 3,664,904 | 5/1972 | Cook | 428/912 |
| 3,736,974 | 6/1973 | Carson . | |
| 3,742,531 | 7/1973 | Allsbury . | |
| 3,761,974 | 10/1973 | Kuss . | |
| 3,801,425 | 4/1974 | Cook | 428/912 X |
| 3,815,165 | 6/1974 | Tobinick et al. | 5/451 |
| 3,952,787 | 4/1976 | Okado et al. | 428/912 X |
| 3,981,342 | 9/1976 | Farber et al. | 428/912 X |
| 4,057,090 | 11/1977 | Hoshikawa et al. | 428/912 X |
| 4,145,780 | 3/1979 | Fogel . | |
| 4,149,286 | 4/1979 | Fogel . | |
| 4,171,237 | 10/1979 | Bohm et al. | 428/912 X |
| 4,192,031 | 3/1980 | Fogel . | |
| 4,370,768 | 2/1983 | Saloff | 5/455 X |
| 4,382,305 | 5/1983 | Hall et al. | 5/451 |

OTHER PUBLICATIONS

Vinyl Products advertisement, two pages, 1979.

*Primary Examiner*—George A. Suchfield
*Attorney, Agent, or Firm*—Sheldon & Mak

[57] ABSTRACT

A waterbed mattress comprises an external envelope and is provided with an internal layer of viscous, polymeric sealing material for sealing punctures in the mattress. The polymeric material can be poly(ether)urethane, which is prevented from sticking to itself by a barrier layer of polyethylene. The mattress is formed from two sheets of polymeric material secured together where the sealing material and barrier are attached to the sheet that forms the top wall of the mattress before the sheets are secured together.

25 Claims, 2 Drawing Figures

SELF-SEALING WATERBED MATTRESS

CROSS-REFERENCES

Figure 1:
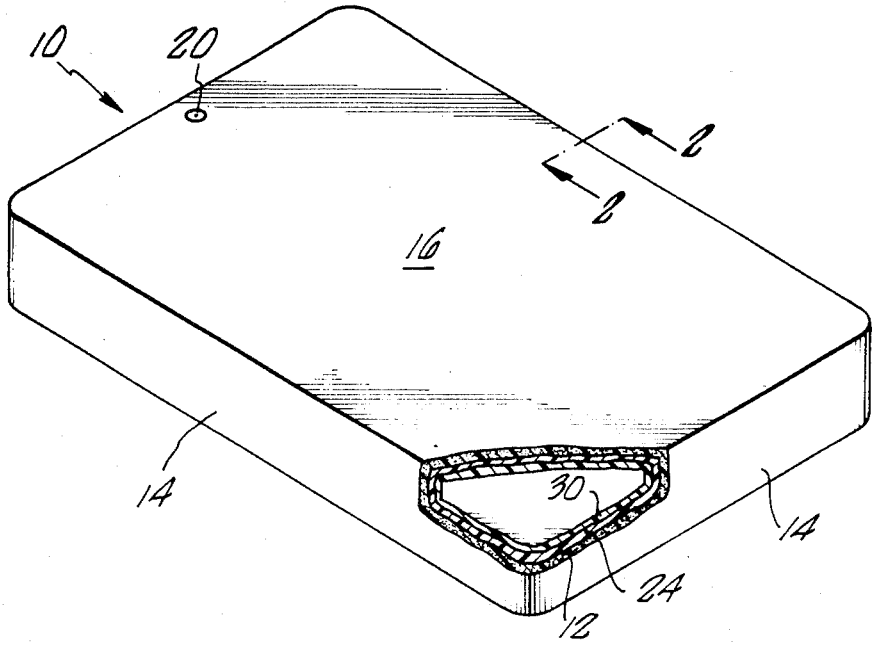

This application is related to application Ser. No. 134,628 filed March 27, 1980, now U.S. Pat. No. 4,382,305, and U.S. patent application Ser. No. 421,369 filed on September 22, 1982, now U.S. Pat. No. 4,501,035, both of which are incorporated herein by this reference. Application Ser. No. 421,369 is a continuation of application Ser. No. 134,628.

BACKGROUND

This invention relates to waterbed mattresses.

Waterbed mattresses are conventionally made of plasticized polyvinylchloride. Polyvinylchloride is an advantageous material to use in that it is durable, flexible, and can easily be bonded to itself by adhesives and heat for forming sheets of polyvinylchloride into the configuration of a waterbed.

However, polyvinylchloride suffers from a disadvantage. A polyvinylchloride mattress can be punctured or torn by misuse from the owner of a waterbed mattress. It is common for an owner of a waterbed mattress, forgetting that he does not have a conventional mattress, to stick a pin into the mattress, thereby causing a leak. Also, cats and other domestic animals are known to rip waterbed mattresses.

There has been no solution to the problem, although attempts have been made to cure its symptoms. These attempts involve the use of exterior waterproof covers around the mattress so as to prevent leaking water from spilling onto surrounding floor surfaces. Such exterior liners are described in U.S. Pat. Nos. 3,761,974; 3,736,604; 3,742,531; 4,149,286; and 4,145,780. However, although these liners can contain leaks, they do nothing to solve the problem of a punctured waterbed mattress.

SUMMARY

The present invention is directed to a self-sealing waterbed mattress. Like the conventional waterbed mattress, the mattress of the present invention comprises a polymeric, puncturable envelope which is ordinarily made of plasticized polyvinylchloride. However, unlike the conventional waterbed mattress, the mattress is provided with an internal layer or film of a sealing material for sealing leaks in the envelope. The sealing material is a self-adhering, water-resistant, material that has a sufficiently high viscosity at 110° F. that it does not flow through a puncture in the envelope. The sealing material is sufficiently tacky that it adheres to the envelope and is pulled into a puncture in the envelope by the object that caused the puncture and seals the puncture against water leakage therethrough. A preferred sealing material is a tacky, non-foamed polyether polyurethane such as a polyurethane comprising the reaction product of a polyoxypropylene glycol and toluene diisocyanate. The sealing material preferably is provided in a film of less than about 50 mils in thickness, and more preferably in a thickness of less than about 10 mils and greater than about 5 mils.

A barrier layer is provided on the inside surface of the sealing material to keep the sealing material from sticking to itself. The barrier layer can be made of polyethylene.

The mattress has a top surface, a bottom surface, and side surfaces. Since leaks usually only occur in the top and side surfaces, preferably the sealing material and barrier are present only at the top and side surfaces, and not the bottom surface. This preferred configuration also permits easy manufacture of the mattress. Waterbed mattresses are often made of two separate sheets of polyvinylchloride, one sheet forming the top and side surfaces and the other sheet forming the bottom surface. According to the present invention, sealant and the barrier are applied only to the sheet used to form the top and side surfaces, and then the two sheets are heat sealed together.

By provision of the sealing material, minor punctures and rips that can occur in a waterbed mattress are automatically sealed. This prolongs the life of the waterbed mattress and prevents water from spilling onto surrounding floor surfaces.

DRAWINGS

Figure 2:
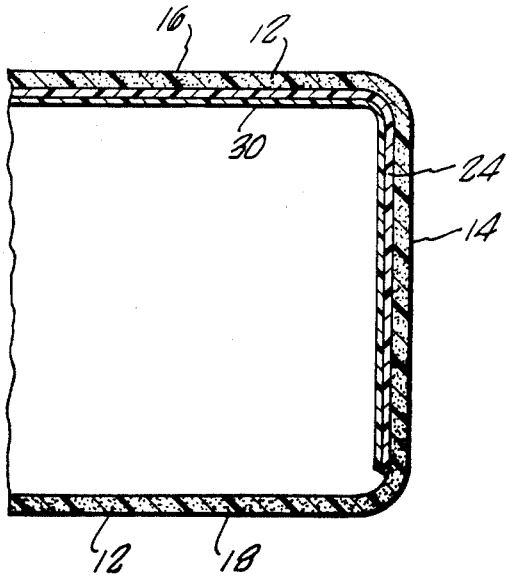

These and other features, aspects, and advantages of the present invention will become better understood with reference to the following description, appended claims, and accompanying drawings where:

FIG. 1 is a perspective view of a waterbed mattress according to the present invention; and FIG. 2 is a sectional view of another version of a waterbed mattress according to the present invention taken along a line corresponding to line 2—2 of FIG. 1.

DESCRIPTION

With reference to FIGS. 1 and 2, there is shown a self-sealing waterbed mattress 10 according to the present invention. The relative thickness of the layers of the mattress 10 is not shown to scale in FIGS. 1 and 2. Like the conventional waterbed mattress, the waterbed mattress 10 comprises an exterior, generally rectangular enclosure or envelope 12 that defines the side 14, top 16, and bottom 18 walls or surfaces of the waterbed mattress 10. The top wall 16 of the waterbed mattress 10 serves as a sleeping surface and is adapted for receiving persons in sitting and reclining positions. The mattress 10 is provided with a fill valve 20.

The envelope 12 is of conventional construction and is generally formed of flexible, plasticized, polyvinylchloride. Its thickness is in the range of from about 10 to about 30 mils, and preferably about 20 mils. The envelope can be formed according to conventional techniques using adhesives and heat welding, and preferably by heat welding the seams. It can be formed by bonding two planar sheets together along their periphery or by bonding upstanding sheets between the edges of the top and bottom walls to form a contoured or fitted structure.

On the internal surface 22 of the envelope 12 is a thin film or layer 24 of a sealing material that serves to seal any leaks that form in the envelope. The sealing material is formed from a self-adhering, water-resistant material, and preferably a polymeric material.

By the term "self-adhering" there is meant a material that when torn into two portions and recontacted to itself, the tensile strength of the recontacted portions at the interface is about the same as the tensile strength of the undisturbed material.

The sealing material serves to automatically seal punctures, rips, cuts and the like in the envelope 12 resulting from domestic animals, pins, nails, knives and razors. In order for the sealing material to function properly, it requires specific rheological properties. It needs to have a sufficiently low viscosity at room temperature, on the order of about 60° F., that it can flow into a puncture hole. It needs to have a sufficiently high viscosity, even at the maximum elevated operating temperatures of the waterbed, i.e., on the order of up to about 110° F., that it does not flow all the way through a puncture in the envelope, i.e. it does not leak out of the envelope.

To determine if a candidate sealing material meets these requirements, a simple test can be conducted. The sealing material is placed in a layer of about 5 to 10 mils thick between two polyethylene bags, each bag being about 4 mils in thickness. The internal bag is filled with about a quart of water at a selected temperature. Both bags are then punctured with a nail to produce a hole of about 1/16 inch in diameter. A satisfactory sealing material is one that seals the hole and prevents water from leaking out at about 60° F. to 100° F., but does not flow out of the hole at 110° F.

Another requirement for the sealing material is that it stays in position as a film or layer adjacent the envelope, even on vertical surfaces of the envelope. In addition, the sealing material should not adversely affect the envelope 12, or any other materials with which the sealing material comes in contact. Preferably the sealing material contains nothing that can migrate through the envelope 12 and is deleterious to the health of the user of the waterbed.

Preferably the sealing material is provided in a film 24 of less than about 50 mils (0.050 inch), because thicker films provide little, if any, improvement in sealing and increase the weight, decrease the flexibility, and increase the cost of the waterbed mattress. If the thickness is much less than about 5 mils, large size holes may not be automatically sealed. Thus, preferably the sealing material is provided in a layer 24 of at least about 5 mils, and preferably from about 5 to about 10 mils in thickness.

For a king-size waterbed, less than 10 pounds of sealing material are required, and generally on the order of from about 5 to about 7 pounds are required.

The preferred material for the sealing material is a tacky poly(ether)polyurethane of sufficiently high viscosity to satisfy these rheological requirement and sufficiently tacky to adhere to the inside walls of the envelope 14. Poly(ether)polyurethanes are used because of their hydrolytic stability.

Preferably the polyurethane is non-foamed because a foamed material would result in a bulky mattress. However, a foamed material can be used to obtain the advantage of heat insulation.

Preferably the polyurethane is the reaction product of a polyisocyanate reactant and a polyether reactant. The aromatic diisocyanates are preferred. Especially preferred are the toluene diisocyanate isomers, particularly the 2, 4-toluene diisocyanate. The commercially available blends of the 2, 4- and 2, 6- isomers are effective; the 80:20 and 65:35 blends are most readily available.

The polyether reactants are hydroxyl group terminated polyfunctional polyethers of the type commonly used in poly(ether)urethane formulations. Preferred are the polyoxyalkylene polyols having 2–4 hydroxyl groups and where the alkylene has 2–6 carbon atoms. The condensation may involve an alkylene oxide, such as ethylene oxide, proplylene oxide, or butylene oxide, with a glycol. Higher polyethers may be obtained by reaction with triol or high polyols, such as glycerine, trimethylolpropane, and pentaerythritol.

Polyols of the above types are available commercially, for example: Voranols (trademark) from Dow Chemical Company; Poly-G (trademark) from Olin Chemicals Division; and Pluracols (trademark) from BASF Wyandotte Corporation.

A preferred polyether reactant comprises polyoxypropylene glycol, comprising diols and triols of only about 10 mole percent triols.

The isocyanate and the polyether can be combined to form a prepolymer where substantially all of the prepolymer terminal groups are isocyanate groups.

The poly(ether)urethane elastomer, which is essentially free of voids, can be formed by combining the prepolymer preparation and the polyisocyanate in the presence of a catalyst. For room temperature curing, preferably a tin catalyst is used.

A preferred poly(ether)urethane elastomer is prepared from toluene diisocyanate and polyoxypropolyene glycol. The final product has an elongation of 1500%, a tensile strength of 100 psi, adheres both to polyvinylchloride sheet and polyethylene sheet, and a flow temperature greater than 275° F. It has a shore A hardness of zero and a tear strength Die C of 15±5 pli. The product has a gel time of about 15 minutes for 200 grams mixed at 72° F. The catalyst component has a viscosity at 72° F. of 770 cp and a specific gravity at 72° F. of 1.027. The prepolymer component has a viscosity at 72° F. of about 750 cp and a specific gravity at 72° F. of 1.034. They are combined in 1:1 proportions by volume.

Such a material is available from Synair Corporation of Chattanooga, Tenn., Formula 4343.

It has been found that a 7 mil layer of this material can seal a pin hole 25 mils in diameter.

A barrier 30 that conforms generally to the shape of the envelope 12 is provided. The barrier 30 adheres to the sealing material and prevents the sealing material from sticking to itself. When waterbed mattresses are shipped, they are folded into a box. Without the barrier 30, the tacky sealing material would stick to itself during shipping.

Preferably the barrier 30 is a thin sheet of polymeric material that maintains its flexibility and tear resistance over a long life and in contact with water. The preferred material for the barrier 30 is polyethylene. A satisfactory barrier as been made from polyethylene that is only ½–1 mil thick.

The barrier can also be an anti-tack agent such as talc or other material that renders the internal surface of the layer of sealing material non-tacky.

A two component polyurethane is particularly adapted for manufacture of a waterbed mattress where the mattress is formed from two sheets, a top sheet and a bottom sheet. Before the polyurethane cures, it has a relatively low viscosity. Therefore it can easily be sprayed or brushed onto the internal surface of the top sheet of the envelope. Then the barrier layer 30 is placed on the layer of sealing material after it has at least partially cured. Because the sealing material is tacky it adheres to the top sheet of the envelope and the barrier sheet 30 adheres to the sealing material. Then the bottom and top sheets are secured together in the conventional fashion such as heat welding to form the mattress.

As shown in FIG. 2, there is no sealing material along the bottom wall 18 of the mattress. However, it is unusual for the leak to form in the bottom wall of the mattress since it rests on the floor or a pedestal. Thus the sealing material is present where needed, namely along the side walls and top wall of the mattress.

Of course, sealing material can be on all of the walls of the mattress by coating all of the sheets used to form the mattress with sealing material.

In one version of the invention, the barrier can be a relatively thick layer of polyethylene or polyurethane foam, i.e., in the order of about ⅛" thick. An advantage of using foam as the barrier is that the foam provides heat insulation to the mattress, reducing the amount of energy required for maintaining the water in the mattress at the desired temperature.

What is claimed is:

1. A self-sealing waterbed mattress comprising a polymeric, puncturable envelope and an internal layer of a self-adhering, water-resistant, sealing material for sealing leaks in the envelope, the sealing material being sufficiently tacky that it adhers to the envelope and can be pulled into a puncture in the envelope by the object that causes the puncture, the sealing material having a sufficiently high viscosity at 110° F. that it does not flow through a puncture in the envelope, the sealing material comprising a polyether polyurethane elastomer.

2. The waterbed mattress of claim 1 including an internal barrier secured to the sealing material for keeping the sealing material from sticking to itself, wherein the layer of sealing material is between the envelope and the internal barrier.

3. The waterbed mattress of claim 2 in which the mattress has a top surface, a bottom surface, and side surfaces, and the sealing material is only at the top and side surfaces, and not the bottom surface.

4. The waterbed mattress of claim 3 in which the barrier is only at the top and side surfaces, and not the bottom surface.

5. The waterbed mattress of claim 2 in which the barrier comprises polyethylene sheet.

6. The waterbed mattress of claim 2 in which the barrier comprises polymeric foam.

7. The waterbed mattress of claim 6 in which the foam is polyurethane or polyethylene foam.

8. The waterbed mattress of claim 1 in which the polyurethane comprises the reaction product of (i) polyoxypropylene glycol or polyoxybutylene glycol and (ii) an aromatic diisocyanate.

9. The waterbed mattress of claim 1 in which the mattress has a top surface, a bottom surface, and side surfaces, and the sealing material is only at the top and side surfaces, and not the bottom surface.

10. The waterbed matress of claim 1 in which the layer of sealing material is less than about 50 mils thick.

11. The waterbed mattress of claim 1 in which the layer of sealing material is from about 5 to about 10 mils thick.

12. The waterbed mattress of claim 1 including an anti-tack material on the inside surface of the layer of sealing material for preventing the sealing material from sticking to itself.

13. The mattress of claim 1 in which the sealing material is non-foamed.

14. A self-sealing waterbed mattress having a top surface, a bottom surface, and side surfaces and comprising:

(a) a polyvinylchloride, puncturable envelope;

(b) an internal layer of a self-adhering, water-resistant, sealing material for sealing leaks in the envelope, the sealing material being sufficiently tacky to stick to the envelope and to be pulled into a puncture in the envelope by the object that causes the puncture, the sealing material having a sufficiently high viscosity at 110° F. that it does not flow through a puncture in the envelope, the sealing material being only at the top and side surfaces and not the bottom surface, the sealing material comprising a non-foamed polyether polyurethane elastomer comprising the reaction product of polyoxypropylene glycol and toluene diisocyanate; and (c) an internal barrier secured to the sealing material for keeping the sealing material from sticking to itself, wherein the layer of sealing material is between the envelope and the internal barrier.

15. The waterbed mattress of claim 14 in which the barrier comprises polymeric foam.

16. The waterbed mattress of claim 15 in which the foam is polyurethane foam or polyethylene foam.

17. A method for fabricating a self-sealing waterbed mattress, the mattress comprising a polymeric puncturable envelope and an internal layer of a tacky, cured, self-adhering, water-resistant, sealing material for sealing leaks in the envelope, the sealing material adhering to the envelope and having a sufficiently high viscosity at 110° F. that it does not flow through a puncture in the envelope, the method comprising the steps of:

(a) selecting first and second sheets of polymeric material;

(b) applying sealing material before it cures to the top sheet;

(c) allowing the sealing material to at least partially cure; and (d) after step (c), heat sealing the top sheet and the bottom sheet together along their periphery to form the envelope.

18. The method of claim 17 in which the sealing material is a polyether polyurethane elastomer.

19. The method of claim 17 in which the sealing material is tacky and the mattress includes an internal barrier secured to the sealing material for keeping the sealing material from sticking to itself, the method including the step of applying the barrier to the at least partially cured sealing material before the step of heat sealing.

20. The method of claim 19 in which the barrier comprises polymeric foam.

21. The method of claim 20 in which the foam is polyurethane foam or polyethylene foam.

22. The method of claim 17 in which the step of applying comprises spraying the sealing material before it cures onto the top sheet.

23. A waterbed mattress having a top wall, a bottom wall, and side walls and comprising:

(a) a polymeric envelope;

(b) an internal layer of a self-adhering adhesive sufficiently tacky to stick to the envelope, the adhesive sticking to at least the top wall of the mattress; and (c) an internal polymeric foam barrier secured to the adhesive for heat insulating the mattress;

wherein the polymeric foam barrier is in direct contact with water when the mattress is filled with water.

24. The mattress of claim 23 in which the foam is polyurethane foam or polyethylene foam.

25. The mattress of claim 23 in which the layer of foam is about ⅛ inch thick.

* * * * *